US007607884B2

(12) United States Patent
Cohen

(10) Patent No.: US 7,607,884 B2
(45) Date of Patent: Oct. 27, 2009

(54) CENTRIFUGAL PUMP WITH MECHANICAL SEAL ARRANGEMENT

(75) Inventor: Carlos Cohen, Toronto (CA)

(73) Assignee: Hayward Gordon Limited, Mississauga, Ontario (CA)

( * ) Notice: Subject to any disclaimer, the term of this patent is extended or adjusted under 35 U.S.C. 154(b) by 496 days.

(21) Appl. No.: 11/456,445

(22) Filed: Jul. 10, 2006

(65) Prior Publication Data

US 2008/0008577 A1 Jan. 10, 2008

(51) Int. Cl.
*F03D 11/00* (2006.01)
*F04D 29/10* (2006.01)
*F03B 11/00* (2006.01)

(52) U.S. Cl. ..... 415/121.1; 415/111; 415/230

(58) Field of Classification Search ..... 415/121.1, 415/121.2, 120, 110, 111, 113, 229, 230; 417/423.11
See application file for complete search history.

(56) References Cited

U.S. PATENT DOCUMENTS

| | | | | |
|---|---|---|---|---|
| 4,449,330 | A | 5/1984 | McCarthy et al. | |
| 4,815,747 | A | 3/1989 | Wolford | |
| 4,840,384 | A | 6/1989 | Dorsch | |
| 4,867,633 | A | 9/1989 | Gravelle | |
| 5,076,757 | A | 12/1991 | Dorsch | |
| 5,344,163 | A | 9/1994 | Roll et al. | |
| 5,460,482 | A | 10/1995 | Dorsch | |
| 5,460,483 | A | 10/1995 | Dorsch | |
| 5,489,187 | A | 2/1996 | Ray | |
| 5,713,719 | A | 2/1998 | Fiore et al. | |
| 5,810,553 | A | 9/1998 | Pedersen | |
| 5,827,042 | A | 10/1998 | Ramsay | |
| 6,190,121 | B1 * | 2/2001 | Hayward et al. | 415/121.1 |
| 6,224,331 | B1 | 5/2001 | Hayward et al. | |
| 6,402,462 | B1 | 6/2002 | Dipl.-Ing | |
| 6,966,749 | B2 | 11/2005 | Loyd et al. | |
| 2005/0045757 | A1 | 3/2005 | Doering et al. | |

FOREIGN PATENT DOCUMENTS

| | | |
|---|---|---|
| WO | WO 01/25640 | 4/2001 |

OTHER PUBLICATIONS

Vaughan Chopper Pumps: Product Catalog, Vaughan Co., Inc., Rev. 6; 2002.

Vaughan Co., Inc. Sales Sheet for Customers; *Why Should You Choose to Use the Vaughan Cartridge Seal for Horizontal and Pedestal Pumps Over other Available Seals*?; Mar. 13, 2003.

(Continued)

*Primary Examiner*—Edward Look
*Assistant Examiner*—Dwayne J White
(74) *Attorney, Agent, or Firm*—Alston & Bird LLP

(57) ABSTRACT

A centrifugal pump with a mechanical seal cartridge is disclosed. The pump has a pump casing, a rotatable drive shaft extending into the casing from the rear side, and an open impeller mounted on the drive shaft, this impeller having radially extending vanes with leading and trailing edges. The seal cartridge is mounted in a back plate structure of the casing so as to seal a central seal chamber formed by the back plate structure and extending around the drive shaft. This seal chamber has a circumferential wall extending around at least a forward portion of the seal mechanism and spaced therefrom so as to form an open annular space for circulation of fluid which lubricates and cools the mechanical seal.

19 Claims, 7 Drawing Sheets

OTHER PUBLICATIONS

Vaughan Chopper Pumps, E-Series Horizontal End Suction Pumps, website page dated Apr. 19, 2004.

Cycloseal Design, by Cornell Pump Company, published in 2002 (1 page).

* cited by examiner

CENTRIFUGAL PUMP WITH MECHANICAL SEAL ARRANGEMENT

FIELD OF THE INVENTION

The present disclosure is directed to centrifugal pumps capable of pumping fluids and, in particular, centrifugal chopper pumps that are able to pump fluids containing solid material.

BACKGROUND ART

A variety of centrifugal pumps are known which are capable of pumping liquids and fluid containing solid matter such as small pieces of garbage or other disposed items. The known chopper pumps have the capability of chopping or cutting solid matter in the liquid mixture, permitting the output from the pump to be disposed of more readily. One known chopper pump is sold by Vaughan, Inc. This pump is provided with a so-called "flushless" mechanical seal which is a cartridge type seal with a coil spring for the seal extending around an inner sleeve that is mounted on the drive shaft. This cartridge seal is mounted in an enclosed chamber formed in a back plate of the pump and extending rearwardly therefrom. The impeller mounted on the drive shaft is a shrouded impeller and the impeller and pump casing are constructed in a manner to keep solids and debris out of the enclosed chamber.

Another known centrifugal pump construction sold by Cornell Pump Company of Portland, Oreg. employs a shrouded impeller have backvanes formed thereon and an enclosed chamber formed behind the shrouded impeller which contains a mechanical seal and an exposed coil spring that engages one side of the mechanical seal and the back of the impeller. The seal chamber is relatively open at the front end but is covered by the impeller. The chamber converges in an axial rearwards direction and has a circumferential wall formed with deflector vanes. According to the manufacturer of this pump, the deflector vanes work with the impeller backvanes to create a fluid action behind the impeller which removes solids and abrasive material from the seal area. However, the impeller used in this pump is a shrouded impeller and the back shroud substantially restricts the flow of fluids into the seal chamber.

Although the prior art pumps having seal chambers with mechanical seals and shrouded (closed) type impellers have been provided in some cases with features intended to keep solids and debris away from the seal chamber, the problem of keeping solids and debris away from the seal chamber is very challenging in the case of pumps employing shrouded impellers because a significant pressure gradient exists between the periphery of the impeller shroud (high pressure) and the seal chamber (low pressure). It will be appreciated that with these pump designs, the natural inclination of the fluid and debris is to go from the high pressure area within the pump towards the low pressure area of the seal chamber. Furthermore, once solids enter the seal chamber, it is difficult to move them out against the high pressure.

In the case of known centrifugal pumps employing a so-called "flushless" seal design together with a shrouded impeller, the makers of these pumps endeavor to prevent solids from getting to the seal chamber. This particular problem has presented difficulties for these pump manufacturers and the cooling of the mechanical seal can often be compromised because fluid circulation through or around the seal is restricted.

The centrifugal pump disclosed herein takes a different approach than prior art centrifugal pumps by providing a central seal chamber which forms an open annular space behind the impeller for circulation of a portion of the fluid in the region of the mechanical seal and by allowing fluid to circulate in the space by using an open impeller construction. In the presently disclosed chopper pump, the chamber and the mechanical seal mounted therein are exposed to the pumped media to a considerable extent and because of the enhanced flow around the mechanical seal, the seal can be effectively cooled and lubricated.

SUMMARY OF THE PRESENT DISCLOSURE

According to an exemplary embodiment of the present disclosure, a centrifugal chopper pump capable of pumping fluid containing solid material includes a pump casing having a frontal intake port, a pump outlet in a side thereof, and a backplate structure forming a central seal chamber extending rearwardly from a central opening formed in a radially extending wall of the back plate structure. A rotatable drive shaft extends into the casing from a rear side of the casing, this drive shaft being rotatable about an axis of rotation in a selected direction of rotation. An open impeller is mounted on this drive shaft for rotation therewith, this impeller having radially extending vanes, each having a sharpened leading edge that extends generally radially in relation to the axis of rotation and each having a trailing edge with a substantially open, circumferentially extending gap between adjacent trailing edges of these vanes. At least one cutter is mounted in the pump casing and is located at the input port. The leading edges of the vanes rotate closely past the at least one cutter during operation of the pump in order to cut up incoming solid material. A mechanical seal mechanism is mounted in the seal chamber. The seal mechanism has a rotating component mounted on the drive shaft and stationary component mounted on the back plate structure. The seal chamber has a circumferentially extending wall extending around at least a forward portion of the seal mechanism and spaced therefrom so as to form an open annular space exposed to the pump fluid and allowing for circulation of a portion of the fluid. During operation of the pump, the seal mechanism effectively seals an annular gap between the drive shaft and the back plate structure while being lubricated and cooled by the aforementioned portion of the fluid being pumped by the chopper pump.

In one particular embodiment of this chopper pump, the circumferentially extending wall of the seal chamber converges in a front to rear axial direction and terminates in an annular forward facing shoulder with the stationary component of the seal mechanism being fixably connected to the back plate structure at this shoulder.

According to another exemplary embodiment of the present disclosure, a centrifugal pump capable of pumping a fluid comprises a centrifugal pump casing having an intake plate forming an intake port, a pump outlet, and a back section forming a seal chamber extending rearwardly from a central opening formed in a radially extending wall of the back section. A drive shaft extends into the casing and through the central opening from a rear side of the casing, the drive shaft being rotatable about an axis of rotation in a selected direction of rotation. An open impeller is mounted on the drive shaft for rotation therewith, the impeller having radially extending vanes, each having a leading edge that extends generally radially in relation to the axis of rotation and each having a trailing edge with a substantially open, circumferentially extending gap between adjacent trailing edges of the vanes. A mechanical seal mechanism is mounted in the seal chamber and the seal mechanism has a rotating component mounted on the drive shaft and a stationary component mounted on the back section. The seal chamber has a circumferentially extending wall extending around at least a forward portion of the seal mechanism and spaced therefrom so as to form an open annular space exposed to the pump fluid for circulation of a portion of the fluid. During operation of the pump, the seal mechanism effectively seals an annular gap between the drive shaft and the back section while being lubricated and cooled by the portion of the fluid being pumped by the pump.

In a particular exemplary embodiment of the centrifugal pump, the circumferentially extending wall of the seal chamber converges in a front to rear axial direction.

In a further exemplary embodiment of the present disclosure, a centrifugal chopper pump capable of pumping a fluid containing a solid material includes a pump casing having a frontal intake port, a pump outlet in the side thereof, and a back plate structure forming a central seal chamber extending rearwardly from an open front end of the chamber. A rotatable drive shaft extends into the casing from a rear side of the casing and this drive shaft is rotatable about an axis of rotation and a selected direction of rotation. An open impeller is mounted on the drive shaft for rotation therewith and this impeller has radially extending vanes, each having a sharpened leading edge that extends generally radially in relation to the axis of rotation. Each vane has a trailing edge with a substantially open, circumferentially extending gap between adjacent trailing edges of the vane. A cutting mechanism is mounted in the pump casing and cooperates with the impeller during use of the pump to cut up incoming solid material. A mechanical seal cartridge is mounted in the back plate structure and on the drive shaft so as to close and seal an annular gap between the drive shaft and the back plate structure while leaving open a front portion of the seal chamber which is exposed to the pump fluid so that the seal cartridge is lubricated and cooled by a portion of the fluid circulating in the front portion during use of the chopper pump. The seal cartridge includes an inner sleeve mounted on the drive shaft, rotatable and stationary seats, a coil spring mounted on and extending around the inner sleeve and mounted so as to press the stationary seat against the rotatable seat, and an annular shroud arrangement. The shroud arrangement covers the circumferential exterior of the coil spring so that the solid material is kept substantially away from contact with the spring.

In a particular exemplary embodiment of this pump, the shroud arrangement includes a stationary annular flange member having a radially inwardly extending flange and an annular seat housing on which the stationary seat is mounted, this seat housing having a cylindrical portion telescoping into the flange member and an annular shoulder extending around its interior. The spring extends between the flange and the shoulder and biases the seat housing and the stationary seat in an axial direction away from the flange.

These and other aspects of the disclosed centrifugal pumps will become more readily apparent to those having ordinary skill in the art from the following detailed description taken in conjunction with the accompanying drawings.

BRIEF DESCRIPTION OF THE DRAWINGS

So that those having ordinary skill in the art to which the present disclosure pertains will more readily understand how to make and use the subject invention, exemplary embodiments thereof will be described in detail herein below with reference to the drawings wherein.

DETAILED DESCRIPTION OF EXEMPLARY EMBODIMENTS

In the detailed description that follows, various exemplary embodiments are described, particularly with reference to the figures appended hereto. However, the particularly disclosed embodiments are merely illustrative of centrifugal chopper pumps and mechanical seal cartridges that can be used in these pumps in order to obtain certain advantages described herein.

Figure 1:
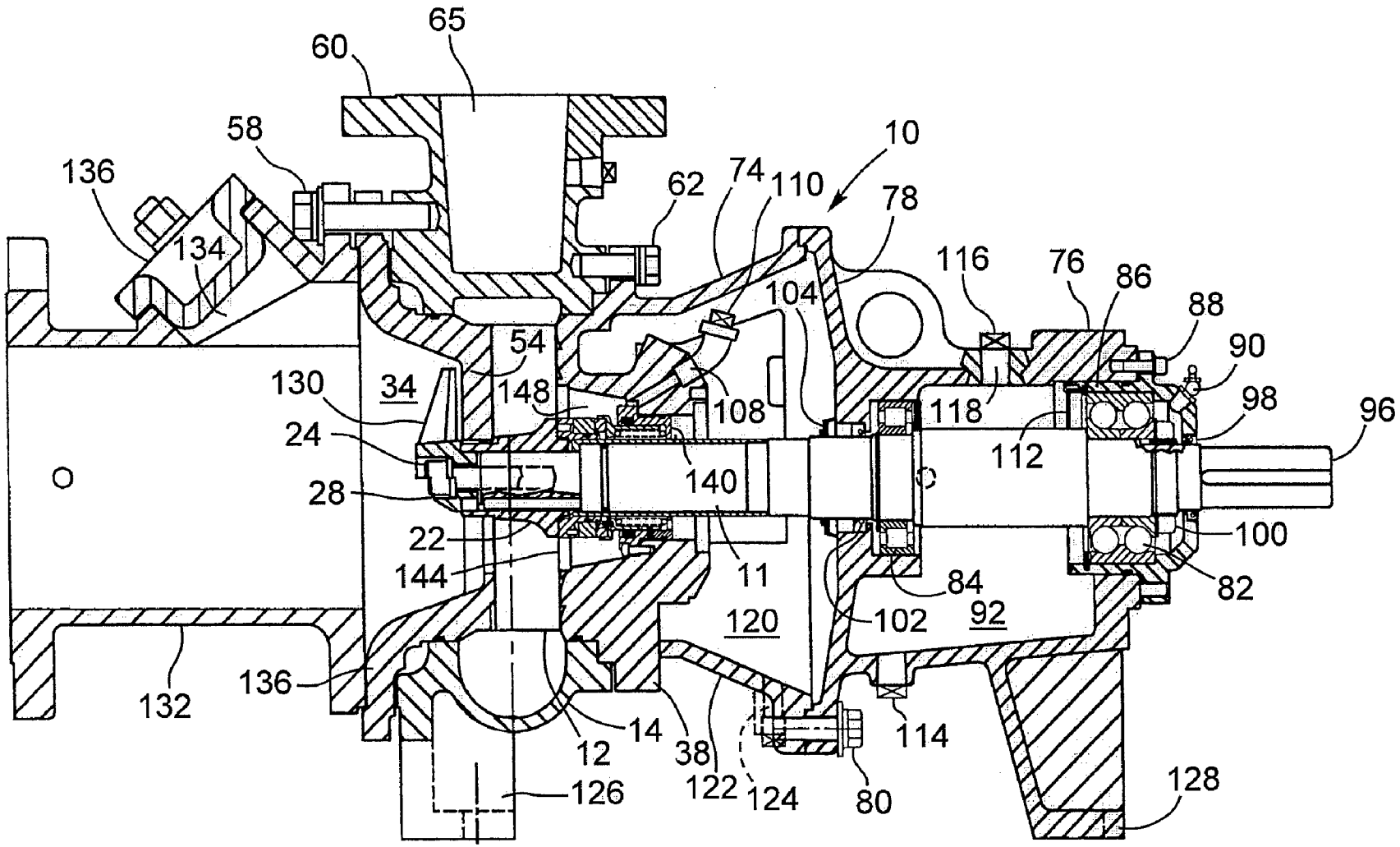
FIG. 1 is an axial cross section of an exemplary centrifugal chopper pump according to the present disclosure, this cross section being taken along the axis of rotation of the drive shaft and impeller of the pump.
Figure 2:
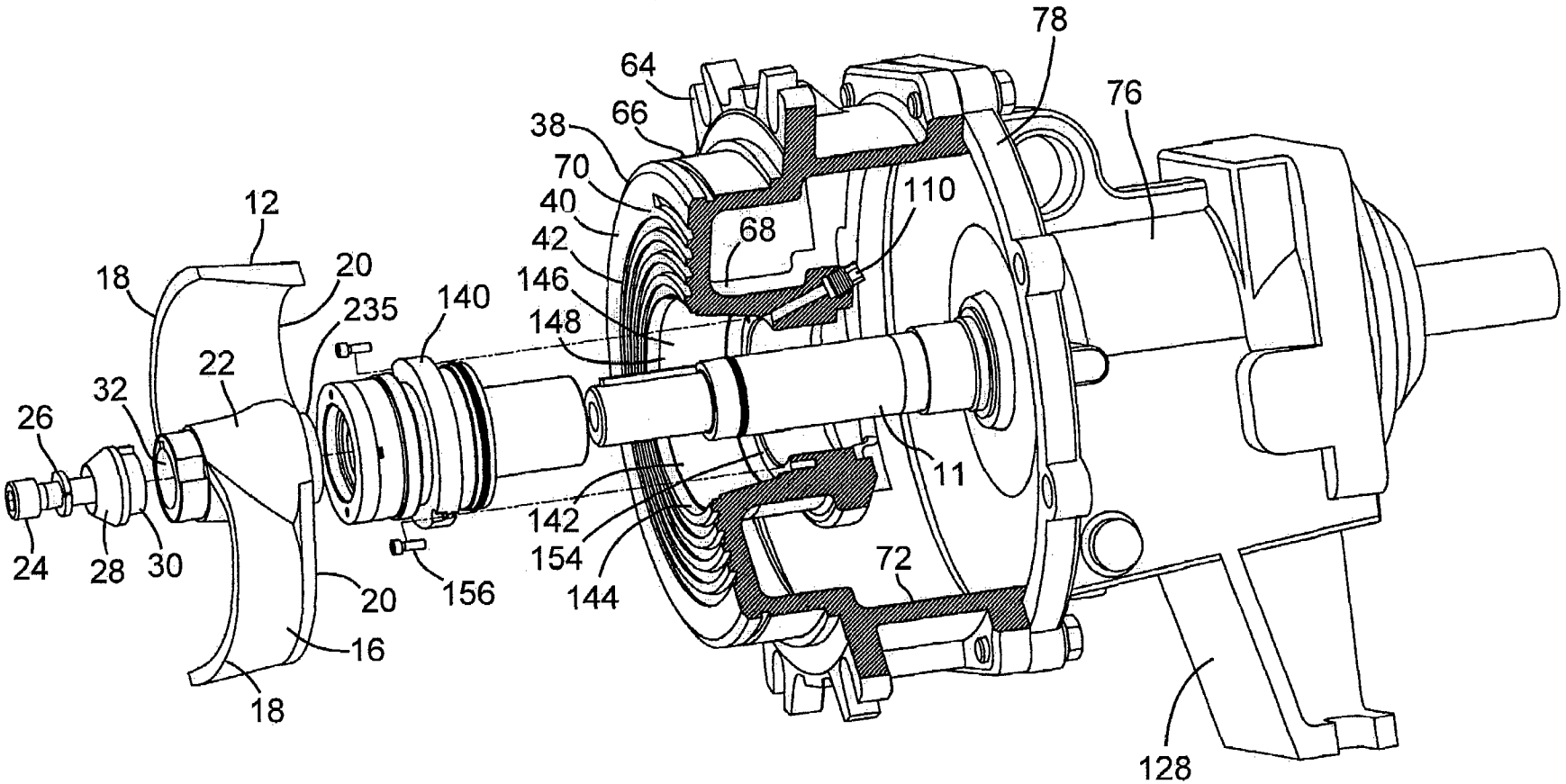
FIG. 2 is an exploded view showing major components of the chopper pump of FIG. 1 in perspective with a back plate structure of the pump being shown in cross section for sake of illustration, this view omitting a circumferentially extending volute member and a cutter intake or front plate of the pump.
Figure 5:
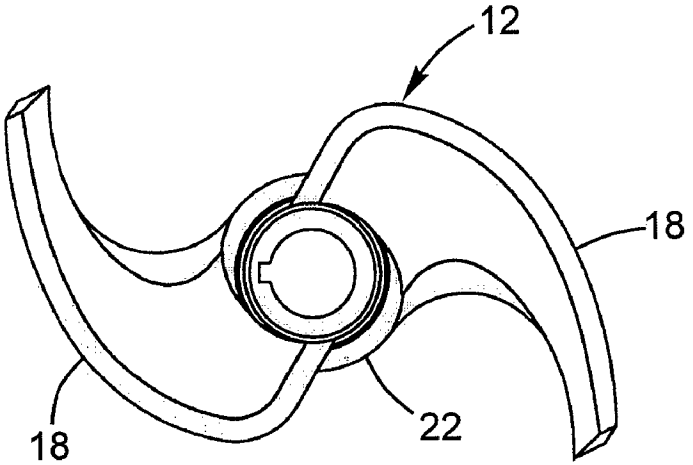
FIG. 5 is a front view of the impeller used in the chopper pump of FIG. 1.
Figure 6:
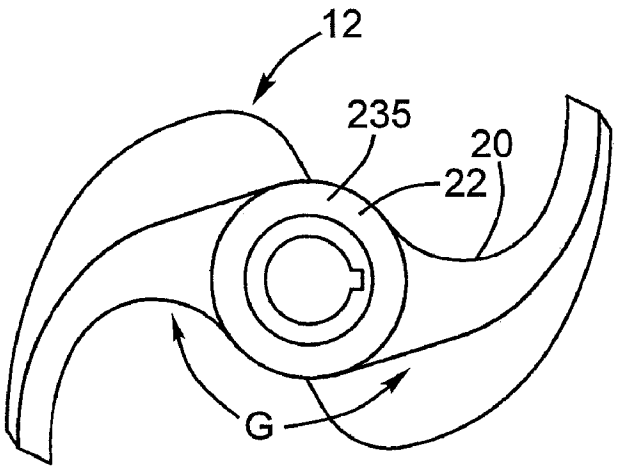
FIG. 6 is a rear view of the impeller used in the chopper pump of FIG. 1.

Referring now to FIGS. 1 and 2 which illustrate major parts of a centrifugal pump 10 constructed in accordance with this disclosure, these major components include a central rotatable drive shaft 11 that defines an axis of rotation along its central longitudinal axis, an open impeller 12 mounted on the drive shaft for rotation and a pump casing 14 made with several major parts that are detachably connected together. The impeller has a set of radially extending vanes 16 of which there can be two or more with the illustrated impeller having only two vanes. The impeller 12 is shown separately in FIGS. 5 and 6. In a known manner, each vane can have a sharpened leading edge 18 that extends generally radially in relation to the axis of rotation and each vane has a trailing edge 20 with a substantially open, circumferentially extending gap indicated at G in FIG. 6 extending between adjacent trailing edges of these vanes. Thus unlike many impellers used in centrifugal pumps, the impeller 12 does not have a back shroud or at least a back shroud of significant size. As used in the present specification, the term "open impeller" refers to an impeller that not only is open on its front side but also has no back shroud or at least no back shroud of significant size. The impeller does have a central hub 22 into which the drive shaft 11 extends and from which the vanes extend radially outwardly. The hub can be secured to the shaft by means of a centre bolt 24 which extends through a washer 26 and a conical impeller shroud 28. The shroud 28 has a reduced diameter rear section 30 that fits into a central passageway 32 extending through the impeller. A key on the rear section 30 fits into a key slot formed on the side of passageway 32 to prevent rotation of the shroud relative to the hub. A further key can also be used to prevent rotation of the impeller on its drive shaft.

Figure 3:
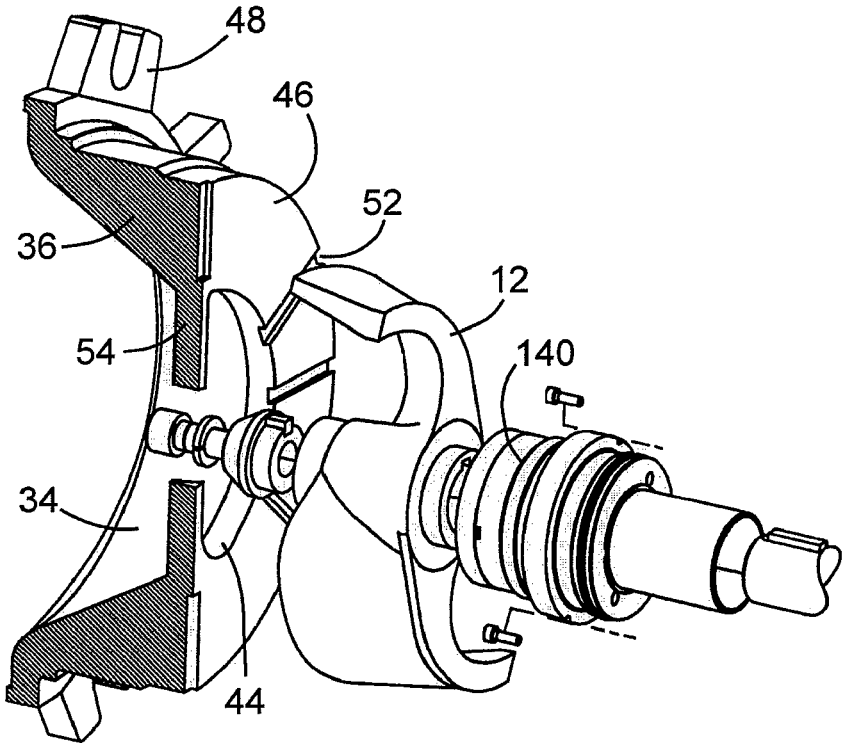
FIG. 3 is another exploded parts view showing a mechanical seal cartridge according to the present disclosure, the pump impeller and a cutter intake member, the latter member shown in axial cross section.
Figure 4:
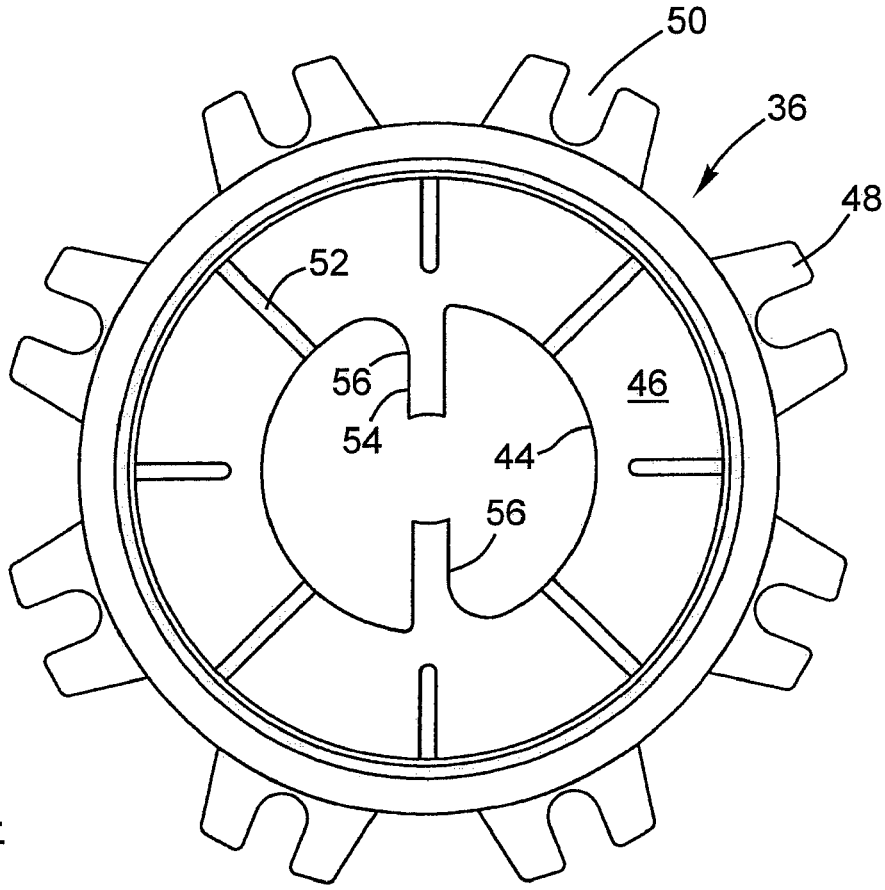
FIG. 4 is a rear view of the cutter intake member of FIG. 3.
Figure 7:
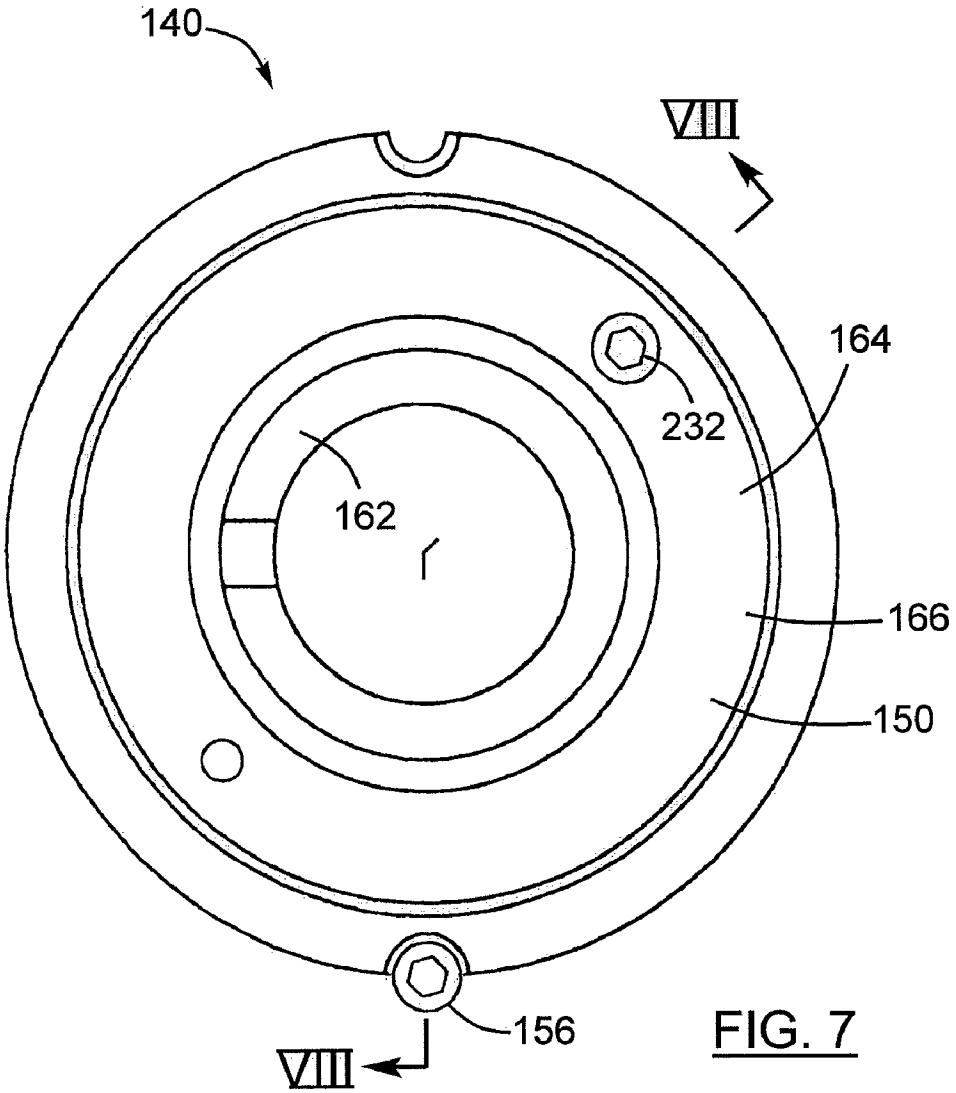
FIG. 7 is a front end view of an exemplary mechanical seal cartridge according to the present disclosure.

In a known manner, the pump casing 14 forms a bowl encircling the impeller. The casing forms a frontal intake port 34 adjacent to the front side of the impeller. The illustrated casing is constructed with the cutter intake port or cover 36 shown in cross section in FIG. 3 and separately in FIG. 4 and a back plate structure 38, the latter having a front surface 40 which is very close to the trailing edges of the vanes. In a known manner, this front surface can be formed with spiral grooves 42 which interact with sharpened trailing edges of the vanes to cut solids that have entered the pump through the intake port. The preferred construction of these spiral grooves is described in detail in U.S. Pat. No. 6,190,121 which issued to Hayward Gordon Limited on Feb. 20, 2001 and the disclosure and drawings of this U.S. patent are incorporated herein by reference.

The illustrated intake plate 36 forms an intake cone in order to funnel the incoming liquid into the pump. Extending radially outwardly from the generally circular inner edge 44 is an inner sidewall 46 forming one side of the pump bowl. The intake plate can be formed with eight connecting ears 48 with each ear having a single bolt receiving notch 50. Also radially extending notches 52 can be formed on the inner sidewall 46, these notches interacting with the sharpened front edges of the vanes in order to provide additional cutting of solids in the liquid mixture during the operation of the pump. In addition, radially inwardly projecting anvil ribs or bars 54 are integrally formed on the intake plate and extend substantially into the intake port. These ribs are also swept closely by the front edges of the vanes during pump operation in order to cut the solids in the liquid mixture. The ribs can have bevelled and sharpened front edges. Thus the bars 54 act as cutters or cutter members which are rigidly mounted in the pump casing. It will be appreciated that there could be as few as one cutter member and there can be more than two cutter members located in the input port. As indicated, the leading edges 18 of the vane rotate closely past the inner edges 56 of the cutter members in order to cut up incoming solid material. As shown in FIG. 1, the intake plate 36 can be attached by eight bolts 58 (only one of which is shown) to volute member 60 which extends about the periphery of the impeller. The back plate structure 38 is connected to the volute member by a suitable number of bolts 62 each of which extends through a notch in an ear 64. The pump casing forms a pump outlet 65 in a side thereof.

The illustrated back plate structure includes a cylindrical outer wall section 66 and a cylindrical inner wall 68. These two wall sections are integrally connected by radially extending wall section 70 which forms the front surface 40. The back plate structure can also include an integral curved rear wall 72 as shown in FIG. 2 which can have a larger diameter than the outer wall section 66. Alternatively, as illustrated in FIG. 1, the back shroud structure can have an integral rearward extension 74 that extends at an angle to the drive shaft. The back plate structure 38 can also be formed of several wall members connected together by bolts, screws or other fasteners (for example, the outer wall section, inner wall 68 and radial wall section 70 can be separate members).

The shaft supporting and shaft lubricating structure located rearwardly of the extension 74 can be constructed in a manner known per se and accordingly a detailed description of this rear portion herein is deemed unnecessary. For example, this rear portion can be constructed in the manner illustrated and described in detail in U.S. Pat. No. 6,190,121, the description and drawings of which are incorporated herein by reference. However, the construction of this rear portion of a centrifugal pump will be reviewed herein for the sake of clarity on the construction of pumps of this general type.

Forming a rear portion of the centrifugal pump is an oil reservoir and bearing support casing indicated generally at 76. This casing is connected to the rearward extension 74 by means of a connecting flange 78. Connecting bolts 80 are used to secure this connecting flange to the extension 74. The casing 76 supports a pair of spaced apart bearings 82 and 84 that rotatably support the drive shaft 11. The outer bearings 82 are mounted in an O-ring bearing housing 86 which is secured to the end of the casing by means of bolts 88. The rear side of the bearing 82 is held in place by means of lock nut 100. Mounted in the bearing housing is a grease nipple 90. Located on the opposite side of the cavity 92, which can be filled with lubricating oil, is the roller bearing 84. Located on the pump side of the bearing 84 is a lip seal 102 which is covered by an inboard slinger 104. The two bearings 82 and 84 can either be lubricated with the oil in the cavity 92 or by means of grease which can be supplied to the bearing 82 by means of the nipple 90. Mounted in front of the bearing 82 is an inboard grease shield 112 which extends around the shaft. It will be understood that if the cavity 92 is filled with lubricating oil, then grease is not required to lubricate the bearings 82 and 84 and grease nipples are not required. Lubricating oil can be drained from the cavity by removing a drain plug 114. Oil can be poured into the cavity by removing a top plug 116 which covers oil passage 118.

A shaft extension 96 which extends out of the casing 76 can be connected to a pump motor (not shown). Surrounding the base of the shaft extension is lip seal 98.

The disclosed back plate structure of the pump is provided with a flush connection or passageway 108 which, when not being used for flushing, is closed at its outer end by a plug 110.

A partially open region 120 can surround a central section of the drive shaft. Extending across the bottom of the region is a connecting plate 122 which can be mounted about the bottom side of the shaft to form a trap to catch any liquids in this region, these liquids being removable through a drain 124.

The illustrated pump can rest on a horizontal surface by means of suitable feet 126 and 128. Two feet 126 (one of which is shown in FIG. 1) can be provided at the front end of the pump and the rear end can be supported by the single foot 128 which can be integrally formed on the casing 76 if desired.

A disintegrator 130 can optionally be mounted on the front end of the drive shaft 11 and can be formed on the aforementioned impeller shroud 28 which acts as its hub. The disintegrator can have two radially projecting, diametrically opposed blades which have edges so that the disintegrator is able to cut solids in the incoming liquid mixture.

Also shown in FIG. 1 is a short intake pipe or suction spool 132 which can have a branch port 134 sealed by removable cover 136. The cover which is held in place by a nuts and bolt connection can be removed for inspection purposes. The aforementioned bolts 58 can also be used to secure the intake pipe 132 in place.

Figure 8:
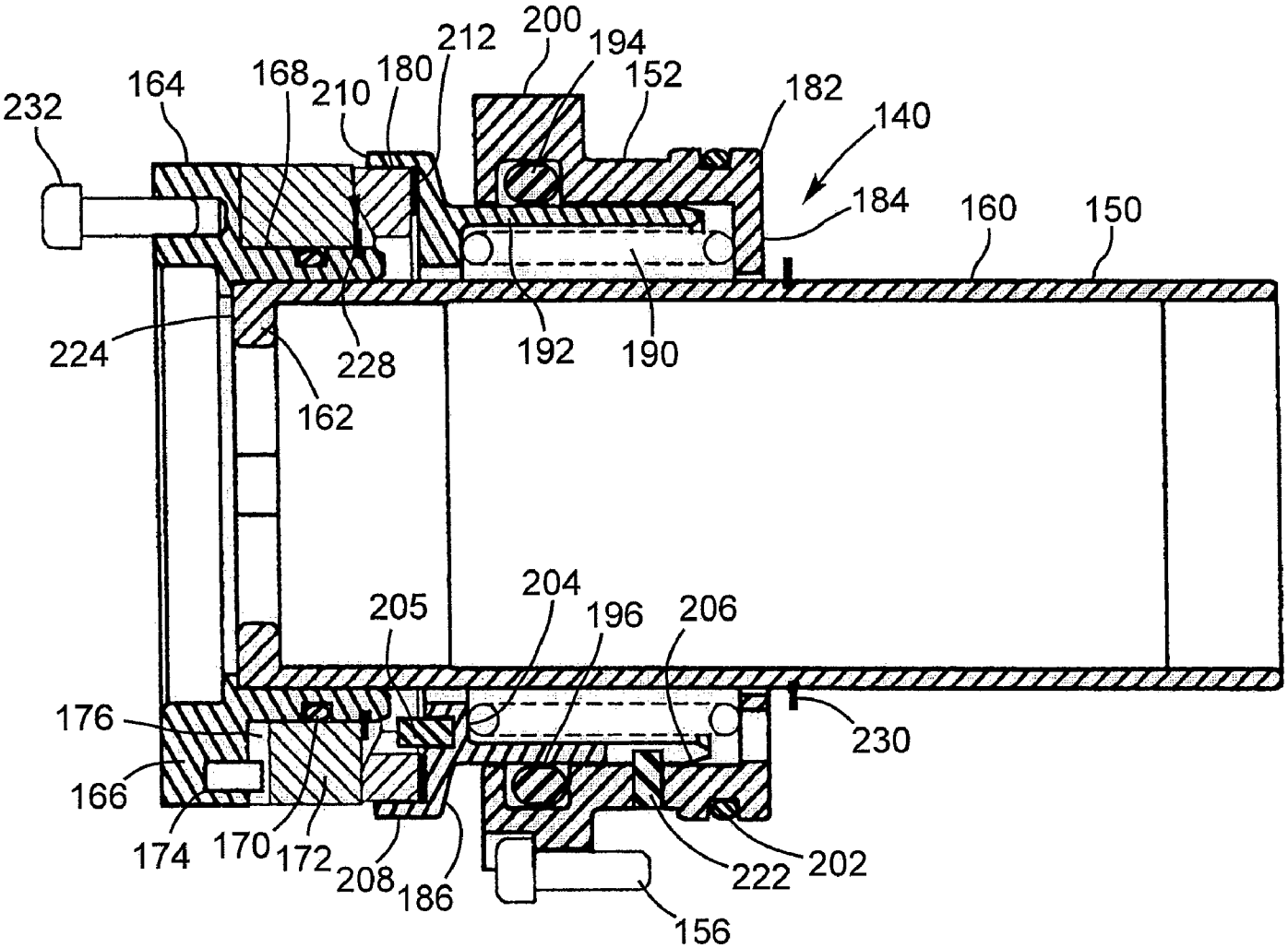
FIG. 8 is a cross sectional view of the mechanical seal cartridge of FIG. 7, this view taken along the line VIII-VIII of FIG. 7.
Figure 11:
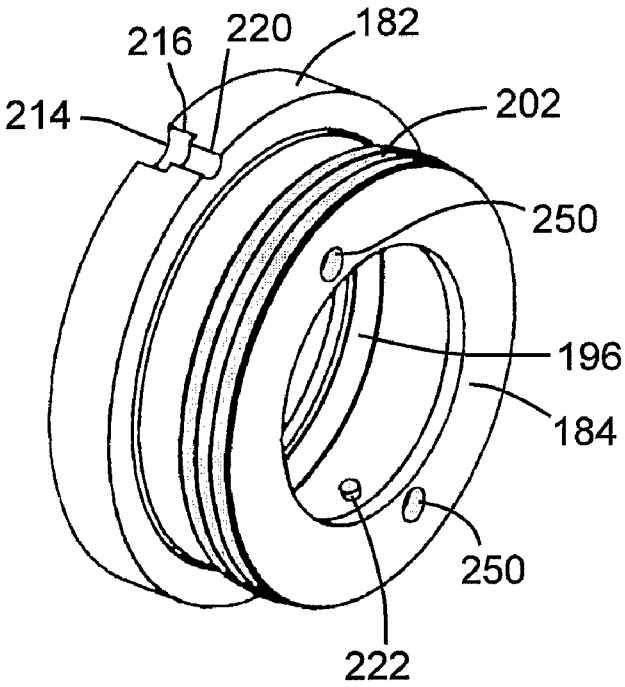
FIG. 11 is an isometric view of a subassembly of the mechanical seal cartridge, this subassembly including a flange member.
Figure 12:
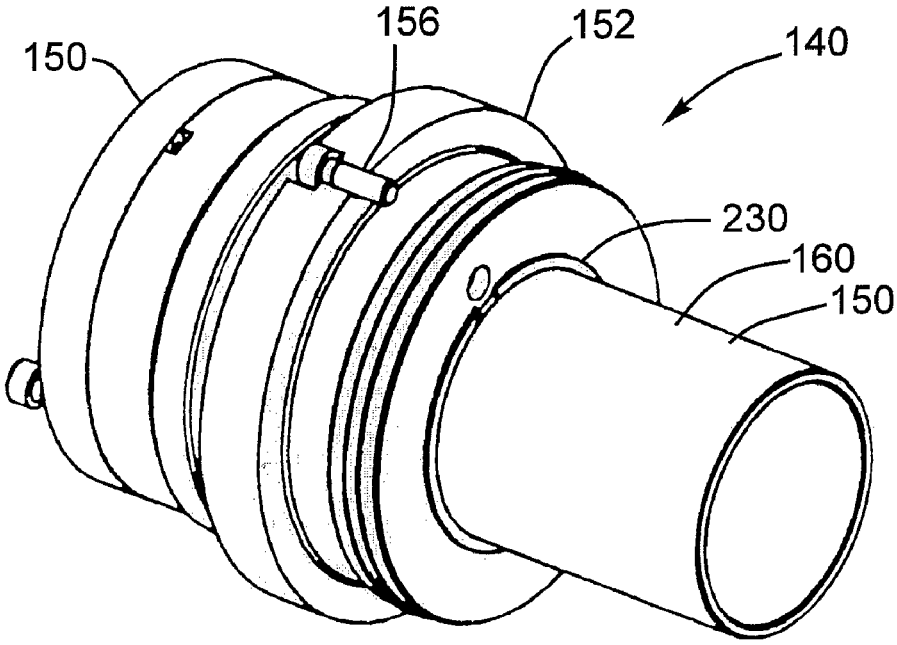
FIG. 12 is an isometric view of the assembled mechanical seal cartridge according to the present disclosure.

The illustrated centrifugal pump 10 has a mechanical seal mechanism 140 shown in axial cross section in FIGS. 1 and 8 and by means of isometric views in FIGS. 2 and 12. This seal mechanism is mounted in a seal chamber 142 in the form of a passageway with a variable circular cross section that extends through the centre of the back plate structure 38 and is coaxial therewith. The chamber is annular since the drive shaft 11 extends along its central axis. Thus the seal chamber has an open front end at 144 and has a circumferentially extending wall 146 that extends around at least a forward portion of the seal mechanism 140 and is spaced therefrom so as to form an open annular space 148 for circulation of a portion of the fluid that is being pumped. The seal mechanism can be considered as a combination of two main components, these being a rotating component 150 which is mounted on the drive shaft 11 and a stationary component 152 which is mounted on the back plate structure 38. The rotating seat sub-assembly is shown separately and in a partially assembled state in FIG. 9 and a stationary seat sub-assembly is shown separately in FIG. 10. The front end of the seal mechanism 140 formed by the rotating component 150 is located adjacent a rear end 235 of the hub 22. A so-called flange sub-assembly is shown separately in FIG. 11 and it will be understood that the two sub-assemblies shown in FIGS. 10 and 11 when combined form the stationary component 152. During operation of the pump, the seal mechanism effectively seals an annular gap formed between the drive shaft and the back plate structure, while being lubricated and cooled by a portion of the fluid being pumped by the chopper pump.

In the exemplary illustrated seal chamber, the circumferentially extending wall 146 converges in a front to rear axial direction and terminates at or near an annular, forward facing shoulder 154. It is also possible for the wall 146 to be cylindrical with a substantially uniform diameter. The stationary component 152 is fixably connected to the back plate structure at this shoulder by means of two screws 156 both of which are shown in FIG. 2. The seal chamber rearwardly of the shoulder can be cylindrical with a uniform diameter. The seal mechanism disclosed herein is a cartridge-type mechanical shaft seal or a seal cartridge which is assembled (as explained hereinafter) prior to installation in the seal chamber. The rotating component of this seal cartridge includes a central sleeve 160 adapted and sized to be mounted on the drive shaft 11 for rotation therewith. This sleeve can be formed with an end flange 162 projecting radially inwardly at one end of the sleeve which can be considered the forward end. This end flange locates the seal cartridge on the drive shaft when the seal cartridge is installed by engaging a shoulder formed on the shaft. The seal support 164 is mounted on the sleeve for rotation therewith. This annular seal support can be made of stainless steel and is formed with a front end section at 166 of larger diameter and a rearward cylindrical portion 168 having a smaller external diameter. Extending about this cylindrical portion is an annular groove which accommodates an O-ring seal 170 which can be made of Buna-N. This seal during the assembly process should be lubricated with grease, for example no. 622 (Chesterton) grease. Extending around the seat support and mounted thereon is an annular first seat 172 which constitutes the rotating seat for pump operation purposes. Thus the joint between the seat and the seat support 164 is sealed by the seal 170. Mounted in the seat support is a short pin 174 which is aligned with a small radial groove 176 formed in the front surface of the seat. Thus by locating the pin in the groove, relative rotation between the seat and the seat support is prevented. The first seat 172 and a second seat 180 can be made of silicon carbide (SiC). The second seat 180 is part of the stationary component 152 which also includes an annular flange member 182 having a radially inwardly extending flange 184 which, in the illustrated exemplary embodiment is located at the rear end of the flange member. The stationary component further includes an annular seat housing 186. The annular second seat 180 is mounted on this seat housing 186 so that when the seal cartridge is assembled, it is adjacent the first seat 172.

A coil spring 190 extends between the seat housing 186 and the flange 184 on the flange member and presses the second seat against the first seat in order to provide the mechanical seal by maintaining a closing pressure sufficient to keep the faces of the two seats together. As clearly shown in FIG. 8, the coil spring 190 extends around the central sleeve 160 and is enclosed by the combination of the flange member 182 and the annular seat housing 186. A cylindrical section 192 of the annular seat housing extends into the flange member in a telescopic manner. An internal annular groove 194 is formed in a forward section of the flange member and mounted in this groove is an O-ring seal 196. This seal is mounted between the cylindrical section and the flange member in order to seal the joint between the cylindrical section and the flange member. When the O-ring seal 196 is installed in its groove, it is lubricated with grease, for example no. 622 (Chesterton) grease. It will be appreciated that the flange member 182 as illustrated has an outer flange 200 which extends radially outwardly and is formed at the forward end of the flange member. The axial depth of this flange accommodates the groove 194. A small annular groove can be formed in a rear end section of the flange member to accommodate a further O-ring seal 202 located a short distance from the rear end of the flange member. When this O-ring seal is installed, it also is lubricated with the aforementioned grease. The seal 202 acts to seal the joint between the flange member and the cylindrical surface forming the rear portion of the seal chamber.

The outer flange 200 has aperture forming means for receiving fasteners used to secure the seal cartridge in the back plate structure 38 of the pump when the seal cartridge is installed in the pump. The aperture forming means can be holes or recesses. It will be appreciated that the illustrated back plate structure in addition to forming a back plate or back surface for the chamber holding the impeller, also forms a type of seal housing in the pump.

The aforementioned flange member 182 and the seat housing 186 can be considered an annular shroud arrangement that covers the circumferential exterior of the coil spring 190 so that the fluid being pumped is kept substantially away from contact with the spring. It will also be appreciated that the seat housing 186 has a cylindrical portion that telescopes into the flange member and, at one end of the cylindrical portion is an annular shoulder 204 that extends around the interior of the seat housing. The forward end of the spring engages and presses against this shoulder and thus biases the seat housing 186 and its stationary seat in an axial direction away from the flange 160. The groove 194 for the inner O-ring seal is formed in a cylindrical inner surface 206 of the flange member, this surface having a diameter only slightly greater than the external diameter of the cylindrical portion 192 of the seat housing. Also the seat housing has a wider front section 208 with an external diameter greater than the cylindrical portion 192. This front section forms a forwardly projecting, annular flange 210 having an internal diameter sized to snuggly accommodate the second seat 180. A gasket 212 is placed between the rear face of the second seat 180 and a front surface of the seat housing. This gasket can be made from Buna-N. The gasket seals the joint between the stationary seat and the seat housing.

An exemplary form of apertures formed in the flange member takes the form of two recesses formed in the outwardly extending flange portion (see FIG. 11). There can be two of these recesses each with a wider front section 216 to accommodate the head of the screw 156, one of which can be seen in FIGS. 8 and 12. Each recess has also a narrower, semi-cylindrical rear section 220. As indicated, the fasteners 156 detachably secure the seal cartridge to the back plate structure and in the seal chamber. Optionally there can be formed in the rear end of the flange member two holes 250 which are simply leakage indicators, ie. if fluid is leaking through these holes then the seal is leaking.

Figure 10:
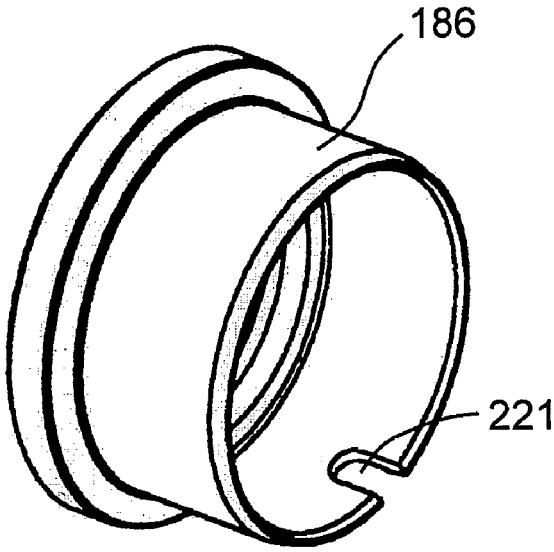
FIG. 10 is an isometric view of a seat housing for a stationary seat sub-assembly of the mechanical seal cartridge.

The aforementioned annular stationary seat support or seat housing 186 is held against rotation relative to the flange member. The one way of preventing this relative rotation is to form the seat support with a groove or slot 221 which extends inwardly from its rear end as shown in FIG. 10. During the assembly process this slot is aligned with a stainless steel pin 222 which is mounted in the flange member so as to project inwardly as shown in FIG. 11.

Figure 9:
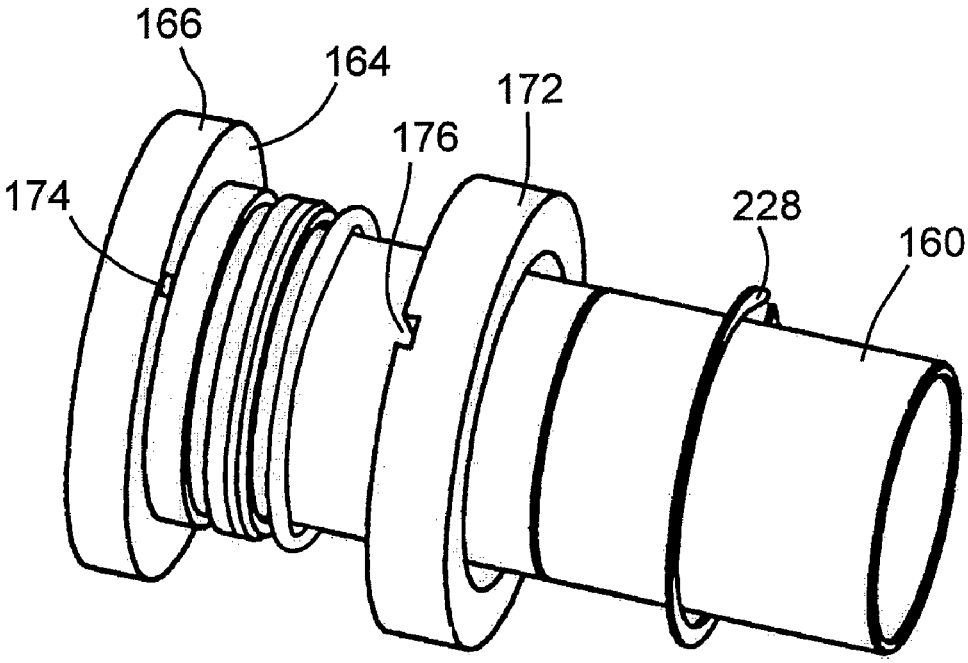
FIG. 9 is an isometric view of a partially assembled subassembly of the mechanical seal cartridge according to the present disclosure, this subassembly including an inner sleeve and a rotating seat.

The assembly of the illustrated embodiment of the seal cartridge will now be described with particular reference to the sub-assemblies and components illustrated in FIGS. 9 to 11. To assemble the rotating seat sub-assembly which is shown partially assembled in FIG. 9, the inner sleeve 160 is pressed into the cylindrical portion 168 of the seat support 164 until it reaches a small step or annular flange 224 formed about the interior of the seat support (see FIG. 8). The O-ring 170 is then installed as described above. Then the first seat 172 is placed on the sleeve 160 and slid forwardly until it is firmly mounted on the seat support. During the installation of the seat, pin 174 is aligned with groove 176 formed in the front surface of the seat. When the rotating seat is in place, a snap ring 228 is used to lock the rotating seat in position. In order to construct the stationary seat sub-assembly shown in FIG. 10, the seat housing 186 is heated to 120 degrees Fahrenheit and then the aforementioned gasket 212 is installed in the wider front section of the seat housing along with the second seat 180. A guide pin 205 is mounted in the front surface of the seat housing and this guide pin is aligned with a groove formed on the radially inner surface of the second seat with engagement between the pin and the sides of the groove preventing rotation between these two members.

The construction of the flange sub-assembly shown in FIG. 11 is straightforward and simply involves the installation of the inner O-ring 196 and the outer O-ring seal 202 and the lubrication thereof with grease.

Once the three aforementioned sub-assemblies have been completed, the complete cartridge seal shown in FIGS. 2 and 12 can be assembled. Firstly, the stationary seat sub-assembly of FIG. 10 is positioned on the sleeve 160 and then pushed towards the rotating seat sub-assembly so that the first and second seats are next to each other and then the spring 190 is installed over the sleeve 160. The flange sub-assembly of FIG. 11 is then shoved onto the rear end of the sleeve and pushed so as to compress together the components including the spring until a further snap ring 230 can be installed on the exterior surface of the sleeve as shown in FIG. 8. This locks the total assembly into a cartridge. During this compression step all of the locating pins in the assemblies including the pin 222 are aligned with their slots or grooves. Once the seal cartridge has been completed, the two screws 156 can then be used to lock the cartridge into the seal chamber. A couple of further screws 232, only one of which is shown, can be used when required in order to extract the cartridge from the seal chamber for servicing. The screws 232 are threaded into two holes formed in the front surface of the seat support 164.

It will be appreciated that when the seal cartridge is mounted and used in the pump, the seal cartridge is hydraulically balanced and this improves its performance and increases its working life. It will also be seen that the exemplary embodiment of the seal cartridge has smooth surfaces and that the coil spring is effectively covered so that it does not become plugged with the solid materials in the fluid being pumped. Because there are no significant protrusion on the forward portion of the seal cartridge, that is forward of the flange member, this helps prevent entering solids and fibers from "hanging up" on or around the seal.

It will be appreciated that the mechanical cartridge seal disclosed herein does not require external clean water flushing and does not require lubrication and/or cooling other than the lubrication and cooling provided from the pumped fluid itself. For purposes of this specification, the terms "clean water flushing" and "secondary lubrication/cooling" have the following meanings:

Clean Water Flushing: A supply of pressurized clean water, such as city water, directed at the mechanical seal so as to provide fluid circulation around the seal faces in order to remove heat and debris from the seal face area and to supplement seal face lubrication.

Secondary Lubrication/Cooling: An alternative method of cooling or lubricating the faces other than using an external clean water flush or the pumped fluid. An example of such an alternative method is to provide for circulation of a "quenching liquid" such as oil on the atmosphere side (as opposed to the pumped fluid side) of the mechanical seal faces.

It will also be understood that the improved pump construction disclosed herein is also applicable to centrifugal pumps other than chopper pumps. Thus it can be used for pumps designed to pump fluids that do not contain solids or chunks of material that need to be cut up or chopped.

While an exemplary embodiment of the present invention has been illustrated and described herein, it is to be understood that the present invention is not limited to the details shown herein, since it will be understood that various omissions, modifications, substitutions and changes in the forms and details of the disclosed centrifugal chopper pump and mechanical seal cartridge for use in such a pump can be made by those skilled in the art without departing in any way from the spirit and scope of the present invention. For example, those with ordinary skill in the art will readily adapt the present disclosure for various other applications without departing from the spirit and scope of the present invention.

The invention claimed is:

1. A centrifugal chopper pump capable of pumping a fluid containing said solid material, said pump comprising:

a pump casing having a frontal intake port, a pump outlet in a side thereof and back plate structure forming a central seal chamber extending rearwardly from a central opening formed in a radially extending wall of said back plate structure;

a drive shaft extending into said casing and through said central opening from a rear side of said casing, said drive shaft being rotatable about an axis of rotation in a selected direction of rotation;

an open impeller mounted on said drive shaft for rotation therewith, said impeller having radially extending vanes each having a leading edge that extends generally radially in relation to said axis of rotation and each having a trailing edge with a substantially open, circumferentially extending gap between adjacent trailing edges of these vanes;

at least one cutter mounted in said pump casing, and located in said input port, the leading edges of said vanes rotating closely past said at least one cutter during operation of the pump in order to cut up incoming solid material; and a mechanical seal mechanism comprising a seal cartridge mounted in said seal chamber, said seal mechanism having a rotating component mounted on said drive shaft and a stationary component mounted on said back plate structure, said rotating component including a central sleeve adapted to and sized to be mounted on said drive shaft for rotation therewith, a seal support mounted on said sleeve for rotation therewith and an annular first seat mounted on the seal support, said stationary component comprising an annular flange member having a radially inwardly extending flange, an annular seat housing, an annular second seat mounted on said seat housing adjacent said first seat, and a spring extending between said seat housing and said flange on said flange member and pressing said second seat against said first seat in order to provide a mechanical seal by maintaining a closing pressure sufficient to keep adjacent faces of the first and second seats together, said seal chamber having a circumferentially extending wall extending around at least a forward portion of said seal mechanism and spaced therefrom so as to form an open annular space exposed to the pumped fluid for circulation of a portion of said fluid, wherein during operation of said pump, said seal mechanism effectively seals an annular gap between said drive shaft and said back plate structure while being lubricated and cooled by said portion of said fluid being pumped by the chopper pump.

2. A centrifugal chopper pump according to claim 1 wherein the circumferentially extending wall of said seal chamber converges in a front to rear axial direction.

3. A centrifugal chopper pump according to claim 1 wherein the circumferentially extending wall of said seal chamber converges in a front to rear axial direction and terminates adjacent an annular forward facing shoulder, said stationary component being fixedly connected to said back plate structure at said shoulder.

4. A centrifugal chopper pump according to claim 1 wherein said spring is a coil spring extending around said central sleeve and enclosed by said flange member and said annular seat housing.

5. A centrifugal chopper pump according to claim 4 wherein a cylindrical section of said annular seat housing extends into said flange member in a telescoping manner and an O-ring seal is mounted between said cylindrical section and the flange member is order to seal a joint between said cylindrical section and the flange member.

6. A centrifugal chopper pump according to claim 1 wherein said mechanical seal mechanism is hydraulically balanced.

7. A centrifugal chopper pump according to claim 1 wherein said impeller has a central hub into which said drive shaft extends and from which said vanes extend radially outwardly and wherein one end of said seal mechanism formed by said rotating component is located adjacent a rear end of said hub.

8. A centrifugal chopper pump according to claim 1 wherein said mechanical seal mechanism does not require external clean water flushing and does not require secondary lubrication or cooling other than said lubrication and cooling provided by the pumped fluid.

9. A centrifugal pump capable of pumping a fluid, said pump comprising:

a centrifugal pump casing having an intake plate forming an intake port, a pump outlet, and a back section forming a seal chamber extending rearwardly from a central opening formed in a radially extending wall of the back section;

a drive shaft extending into said casing and through said central opening from a rear side of said casing, said drive shaft being rotatable about an axis of rotation in a selected direction of rotation;

an open impeller mounted on said drive shaft for rotation therewith, said impeller having radially extending vanes each having a leading edge that extends generally radially in relation to said axis of rotation and each having a trailing edge with a substantially open, circumferentially extending gap between adjacent trailing edges of these vanes; and a mechanical seal mechanism comprising a seal cartridge mounted in said seal chamber, said seal mechanism having a rotating component mounted on said drive shaft and a stationary component mounted on said back section, said rotating component including a central sleeve adapted to and sized to be mounted on said drive shaft for rotation therewith, a seal support mounted on said sleeve for rotation therewith, and an annular first seat mounted on said seal support, said stationary component comprising an annular flange member having a radially extending flange, an annular seat housing, an annular second seat mounted on said seat housing adjacent said first seat, and a spring extending between said seat housing and said flange on said flange member and pressing said second seat against said first seat in order to provide a mechanical seal by maintaining a closing pressure sufficient to keep adjacent faces of the first and second seats together, said seal chamber having a circumferentially extending wall extending around at least a forward portion of said seal mechanism and spaced therefrom so as to form an open annular space exposed to the pump fluid for circulation of a portion of said fluid, said circumferentially extending wall converging in a front to rear axial direction, wherein during operation of said pump, said seal mechanism effectively seals an annular gap between said drive shaft and said back section while being lubricated and cooled by said portion of said fluid being pumped by the pump.

10. A centrifugal pump according to claim 9 wherein a cylindrical section of said annular seat housing extends into said flange member in a telescoping manner and an O-ring seal is mounted between said cylindrical section and the flange member is order to seal a joint between said cylindrical section and the flange member.

11. A centrifugal pump according to claim 9 wherein said mechanical seal does not require external clean water flushing and does not require secondary lubrication or cooling other than said lubrication and cooling provided by the pumped fluid.

12. A centrifugal chopper pump capable of pumping a fluid containing a solid material, said pump comprising:

a pump casing having a frontal intake port, a pump outlet in a side thereof, and a back plate structure forming a central seal chamber extending rearwardly from an open front end of the chamber;

a rotatable drive shaft extending into said casing and through the seal chamber from a rear side of said casing, said drive shaft being rotatable about an axis of rotation in a selected direction of rotation;

an open impeller mounted on said drive shaft for rotation therewith, said impeller having radially extending vanes each having a leading edge that extends generally radially in relation to said axis of rotation and each having a trailing edge with a substantially open, circumferentially extending gap between adjacent trailing edges of the vanes;

a cutting mechanism mounted in said pump casing and co-operating with said impeller during use of said pump to cut up incoming solid material;

and a mechanical seal cartridge mounted in said back plate structure and on said drive shaft so as to close and seal an annular gap between said drive shaft and said back plate structure while leaving open a front portion of said seal chamber which is exposed to the pump fluid so that the seal cartridge is lubricated and cooled by a portion of said fluid circulating in said front portion during use of the chopper pump, said seal cartridge including an inner sleeve mounted on said drive shaft, rotatable and stationary seats, a coil spring mounted on and extending around said inner sleeve and mounted so as to press said stationary seat against said rotatable seat, and an annular shroud arrangement covering the circumferential exterior of said coil spring so that said solid material is kept substantially away from contact with said spring.

13. A pump according to claim 12 wherein said shroud arrangement includes a stationary, annular flange member having a radially inwardly extending flange and an annular seat housing on which said stationary seat is mounted, said seat housing having a cylindrical portion telescoping into said flange member and an annular shoulder extending around its interior, and wherein said spring extends between said flange and said shoulder and biases said seat housing and said stationary seat in an axial direction away from said flange.

14. A pump according to claim 13 wherein an O-ring seal is mounted in an internal groove formed in said flange member and acts to seal a joint between said cylindrical portion of said seat housing and a cylindrical inner surface of said flange member.

15. A pump according to claim 14 wherein said flange member also has an outer flange which extends radially outwardly, is spaced forwardly from the inwardly extending flange, and has apertures through which threaded fasteners extend, and wherein said fasteners detachably secure said seal cartridge to said back plate structure and in said seal chamber.

16. A pump according to claim 14 wherein said inner sleeve is formed with an end flange projecting radially inwardly at one end of said sleeve closest to the impeller, said end flange properly locating said seal cartridge on said drive shaft by engaging an annular shoulder formed on the drive shaft.

17. A pump according to claim 12 wherein said front portion of said seal chamber is formed by a circumferentially extending wall which converges in a front to rear axial direction of the pump and a substantial annular space is provided between said seal cartridge and at least most of the axial length of said wall.

18. A pump according to claim 13 wherein said seal cartridge is installed in said pump so as to be hydraulically balanced when said pump is being used.

19. A pump according to claim 13 wherein said impeller has a central hub from which said vanes extend and said hub is mounted on said drive shaft so that a rear end of said hub is adjacent a front end of the seal cartridge.

* * * * *

UNITED STATES PATENT AND TRADEMARK OFFICE

CERTIFICATE OF CORRECTION

PATENT NO. : 7,607,884 B2
APPLICATION NO. : 11/456445
DATED : October 27, 2009
INVENTOR(S) : Carlos Cohen It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 605 days.

Signed and Sealed this

Fourteenth Day of December, 2010

David J. Kappos

David J. Kappos
*Director of the United States Patent and Trademark Office*